US006870146B2

(12) United States Patent
Yamaguchi

(10) Patent No.: US 6,870,146 B2
(45) Date of Patent: Mar. 22, 2005

(54) HIGH-FREQUENCY HEATING APPARATUS

(75) Inventor: Takahide Yamaguchi, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 227 days.

(21) Appl. No.: 10/448,662

(22) Filed: May 30, 2003

(65) Prior Publication Data

US 2004/0007571 A1 Jan. 15, 2004

(30) Foreign Application Priority Data

May 31, 2002 (JP) ..... 2002-159959
Apr. 18, 2003 (JP) ..... 2003-113862

(51) Int. Cl.[7] ..... H05B 6/80
(52) U.S. Cl. ..... 219/757; 219/681; 126/299 R
(58) Field of Search ..... 219/400, 681, 219/685, 715, 716, 754, 756, 757, 758, 760, 762; 126/21 A, 275 E, 299 R

(56) References Cited

U.S. PATENT DOCUMENTS 5,874,714 A * 2/1999 Sik ..... 219/756
5,938,967 A * 8/1999 Reo et al. ..... 219/756
6,414,287 B2 * 7/2002 Han et al. ..... 219/756
6,509,556 B2 * 1/2003 Kim ..... 219/757

FOREIGN PATENT DOCUMENTS

JP 08-203664 8/1996

* cited by examiner

*Primary Examiner*—Tu Hoang
(74) *Attorney, Agent, or Firm*—RatnerPrestia

(57) ABSTRACT

A high-frequency heating apparatus includes an outer enclosure, a high voltage generator such as a high-voltage capacitor, and an air guide, wherein the air guide is provided with a plastic hinge formed by partially reducing a wall thickness thereof. The invented structure can bend the plastic hinge to locate an end flap of air guide in a space between a terminal of the high-voltage capacitor and the outer enclosure defining a dead metal part, to easily ensure electrical insulation between the terminal and the outer enclosure without dependent on variations in quality of workmanship in the manufacturing process. In addition, it can reduce a number of working processes as well as amount of waste since all it requires is to bend the plastic hinge to provide the electrical insulation.

20 Claims, 8 Drawing Sheets

HIGH-FREQUENCY HEATING APPARATUS

FIELD OF THE INVENTION

The present invention relates to a high-frequency heating apparatus having a structure designed to easily and reliably ensure electrical insulation of electric terminals charged with high voltage such as those of a high-voltage transformer and a high-voltage capacitor from electrically dead metal parts including a chassis and an outer enclosure that are accessible to a user. The structure comprises a plastic member having a plastic hinge, which is bent either manually or automatically as the outer enclosure is installed after the high-voltage carrying terminals are wired, so that an end flap extending from the bent plastic hinge is located in a space between the high-voltage carrying terminals and the dead metal parts.

BACKGROUND OF THE INVENTION

In a conventional high-frequency heating apparatus, it is a general practice to separate high voltage carrying parts such as terminals of a high-voltage capacitor from a dead metal part such as an outer enclosure, which is accessible to a user, or to place an insulating material such as a plastic sheet on a surface of the dead metal part confronting the high voltage carrying parts where a sufficient space is not available for separation, in order to ensure electric insulation. FIG. 5 shows an example of such structures.

FIG. 5 depicts outer enclosure 1, high-voltage capacitor 2 and plastic sheet 3 made of an insulating material. Due to a limited space between terminals 2A of high-voltage capacitor 2 and outer enclosure 1, this structure ensures the electric insulation by placing plastic sheet 3 of the insulating material on a surface of outer enclosure 1 facing high-voltage capacitor 2.

There is another example of electric insulation between terminals of the high-voltage capacitor and a dead metal part such as the outer enclosure, as shown in FIG. 6, in which a thickness of an air guide is partially reduced to form a plastic hinge in a bottom side of it, and a portion of the air guide is bent downward. In FIG. 6, reference numerals 4 and 5 represent the air guide and a cooling fan respectively. High-voltage capacitor 2 is mounted under bottom side 4A of air guide 4, and end flap 4D is bent downward with plastic hinge 4B formed in air guide 4 so as to be located between terminals 2A of high-voltage capacitor 2 and the outer enclosure (not shown) to provide the electric insulation.

FIG. 7 shows air guide 4 of the prior art indicating a direction of separating a pair of molding dies, and FIG. 8 is a schematic illustration indicating a flow of cooling air in the vicinity of high-voltage capacitor 2 in a structure of the prior art, wherein reference numeral 6 represents a high-voltage transformer.

There is also another example of ensuring electric insulation between terminals of the high-voltage capacitor and the dead metal part such as the outer enclosure by mounting an insulation cover, as shown in FIG. 9. This example is disclosed in Japanese Patent Unexamined Publication No. H08-203664. In FIG. 9, insulation cover 8 covers high-voltage capacitor 2, high-voltage transformer 6 and magnetron 7 in a manner to isolate electrically the entire high voltage components from an outer enclosure (not shown).

However, in the conventional structure, which uses plastic sheet 3 to provide the electrical insulation as shown in FIG. 5, positioning of plastic sheet 3 depends on workmanship in a manufacturing process of the high-frequency heating apparatus. It is therefore necessary to make plastic sheet 3 larger in size in order to ensure the electrical insulation, taking into consideration that a deviation of certain extent is inevitable in the positioning. The increase in size of plastic sheet 3 makes the work of placing it difficult, and increases cost of the material. Besides, since plastic sheet 3 is stuck with glue or adhesive material, it is liable to fail the electrical insulation when it loses the adhesive property and comes off the position due to deterioration over time. In addition, because plastic sheet 3 is generally supplied as being backed with a liner of paper or film, it involves many working processes including such steps as removing plastic sheet 3, placing it on to outer enclosure 1, and disposing the liner as waste in the course of manufacturing the high-frequency heating apparatuses. This results in a considerable amount of waste matter at the same time.

On the other hand, in the structure having air guide 4 with plastic hinge 4B formed by partially reducing wall thickness in bottom side 4A as shown in FIG. 6, plastic hinge 4B cannot be bent directly downward at right angles because it has a tapered thickness to facilitate ejection from the molding dies, since the direction of separating the pair of molding dies of air guide 4 is in parallel with plastic hinge 4B, as shown in FIG. 7. If the molding dies are provided with a slide core or the like to avoid the tapered thickness, it makes a structure of the molding dies complex, shortens a useful life of the molding dies, and increases a labor and cost required for maintenance of the molding dies. Furthermore, since high-voltage capacitor 2 is disposed under bottom side 4A of air guide 4, as shown in FIG. 8, high-voltage capacitor 2 receives only a part of the cooling air reflected by high-voltage transformer 6. This also gives rise to a problem of substantially reducing cooling efficiency of high-voltage capacitor 2, because the cooling air reflected by high-voltage transformer 6 turns to hot air as it receives the heat of high-voltage transformer 6.

In addition, the conventional structure provided with separately mounted insulation cover 8, as shown in FIG. 9, increases a number of components due to the addition of insulation cover 8, and reduces working efficiency in the process of assembly. Moreover, since insulation cover 8 has a function of rectifying the cooling air, it needs to be considerably large in size, and therefore giving rise to another problem of increase in cost of the material.

SUMMARY OF THE INVENTION

The present invention addresses the above-discussed problems, and aims to ensure electrical insulation reliably and improve cooling efficiency of the high-voltage capacitor, while reducing a number of working steps as well as amount of waste in the manufacturing processes.

A high-frequency heating apparatus of the present invention is provided with an air guide having a barrier wall located between a high-voltage transformer and a high-voltage capacitor, the barrier wall of the air guide being reduced in thickness partially to form a plastic hinge, which is bent either manually or automatically after high-voltage terminals of the high-voltage capacitor and the like are wired, so that an end flap extending from the bent hinge isolates the high-voltage carrying terminals of the high-voltage capacitor and the like from a dead metal part such as an outer enclosure, and provides for an electrical insulation. The invention also reduces substantially time and waste that have been needed for placement of plastic sheets for the purpose of electrical insulation in the process of manufacturing high-frequency heating apparatuses. Furthermore, since the plastic end flap covering the high voltage terminals bears a cautionary marking, it can elicit attention of a service personnel and user against electric shock before he/she comes to contact with the terminals of the high-voltage capacitor and the like.

BRIEF DSCRIPTION OF THE DRAWINGS

DETAILED DESCRIPTION OF THE PREFERRED EMBODIMENTS

Exemplary embodiments of the present invention are described with reference to the accompanying drawings.

First Exemplary Embodiment

Figure 1:
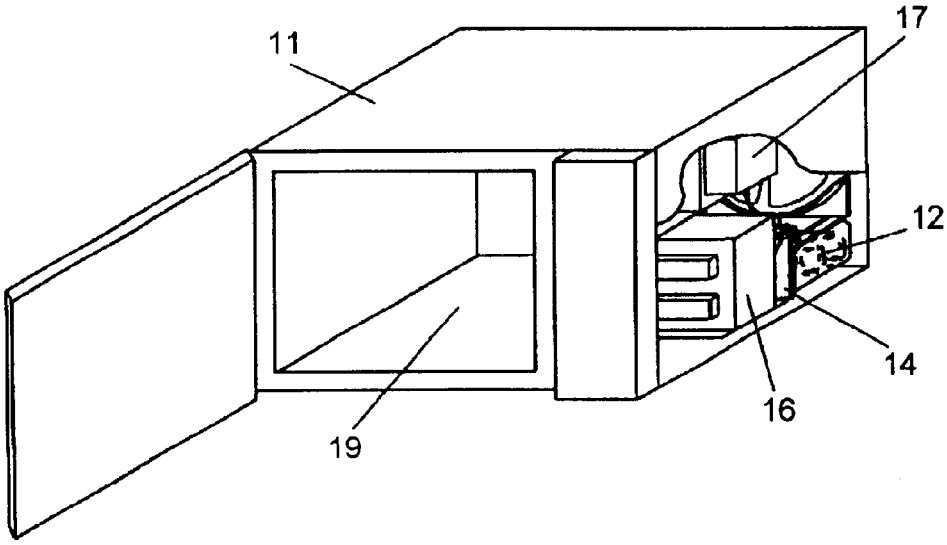
FIG. 1 is a partially sectioned perspective view of a high-frequency heating apparatus according to a first exemplary embodiment of the present invention.
Figure 2:
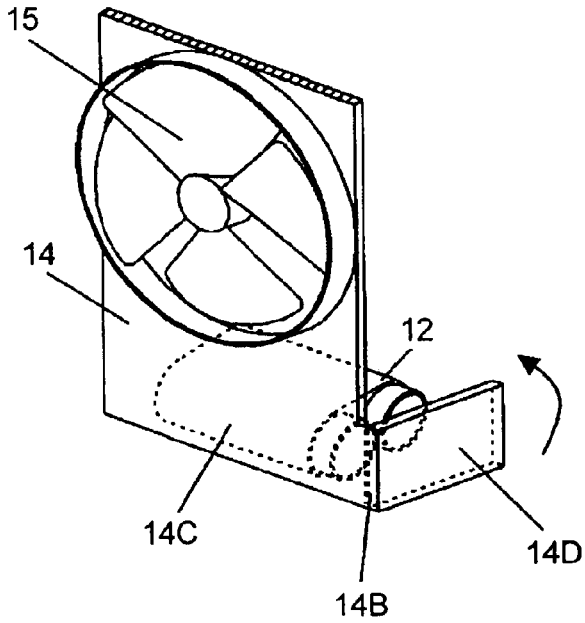
FIG. 2 is an enlarged perspective view showing a main portion of the high-frequency heating apparatus of the first exemplary embodiment of the invention.
Figure 3:
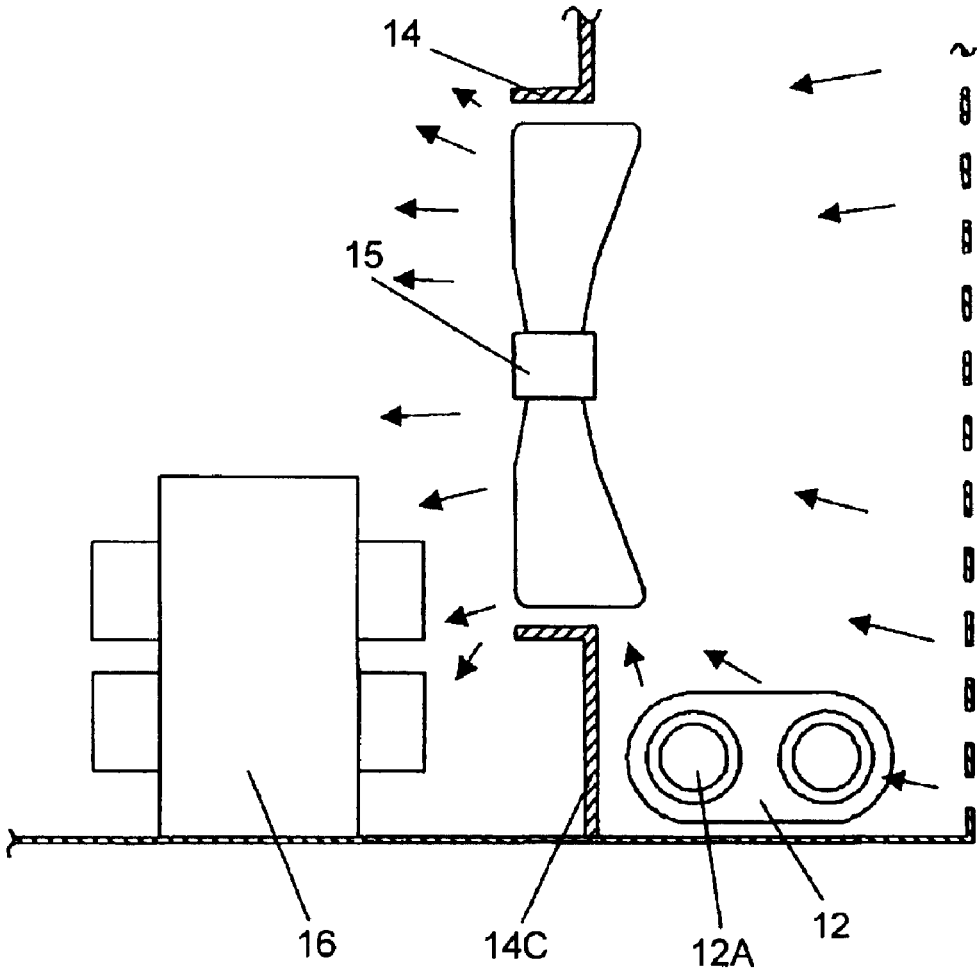
FIG. 3 is a sectional view of the main portion of the high-frequency heating apparatus of the first exemplary embodiment of the invention.

FIG. 1 through FIG. 3 show a high frequency heating apparatus according to the first exemplary embodiment of this invention, wherein FIG. 1 is a partially sectioned perspective view, FIG. 2 is an enlarged perspective view showing a main portion, and FIG. 3 is sectional view showing the main portion.

In FIG. 1 through FIG. 3, high-voltage capacitor 12 and high-voltage transformer 16 supplies electric power of a boosted voltage to magnetron 17, which heats food placed in heating chamber 19. Air guide 14 is provided with barrier wall 14C between high-voltage transformer 16 and high-voltage capacitor 12, and barrier wall 14C is provided with plastic hinge 14B having a partially reduced wall thickness. Plastic hinge 14B is so formed that, when it is bent, end flap 14D is located in a space between terminal 12A of high-voltage capacitor 12 and outer enclosure 11 defining a dead metal part.

According to this exemplary embodiment, the structure described above easily and reliably ensures electrical insulation between terminal 12A of high-voltage capacitor 12 and outer enclosure 11 defining the dead metal part, by simply bending plastic hinge 14B provided in barrier wall 14C of air guide 14, and locating end flap 14D in the space between terminal 12A of high-voltage capacitor 12 and outer enclosure 11. This embodiment can also reduce time spent for placement of a plastic sheet that has been needed for the conventional structure and waste of useless liner. In addition, since plastic hinge 14B is formed orthogonally to a direction of separating a pair of molding dies of air guide 14, plastic hinge 14B is not tapered in thickness, which can simplify a structure of the molding dies of air guide 14. Furthermore, as shown in FIG. 3, since barrier wall 14C of air guide 14 separates high-voltage capacitor 12 from high-voltage transformer 16, it prevents hot air heated by high-voltage transformer 16 from circulating through high-voltage capacitor 12, but high-voltage capacitor 12 receives cool air introduced from the outside of the enclosure instead of the hot air, as it is located in a cooling air path. This structure improves cooling efficiency of high-voltage capacitor 12.

End flap 14D extends beyond a boundary plane of outer enclosure 11 when plastic hinge 14B is not bent. Since this causes end flap 14D to interfere with outer enclosure 11 when outer enclosure 11 is being installed in the manufacturing process, it makes possible detection of a product of which plastic hinge 14B is not bent. As a result, it prevents a product from being shipped to the market in a condition where the electrical insulation is not secured, thereby improving quality of the product.

Second Exemplary Embodiment

Figure 4:
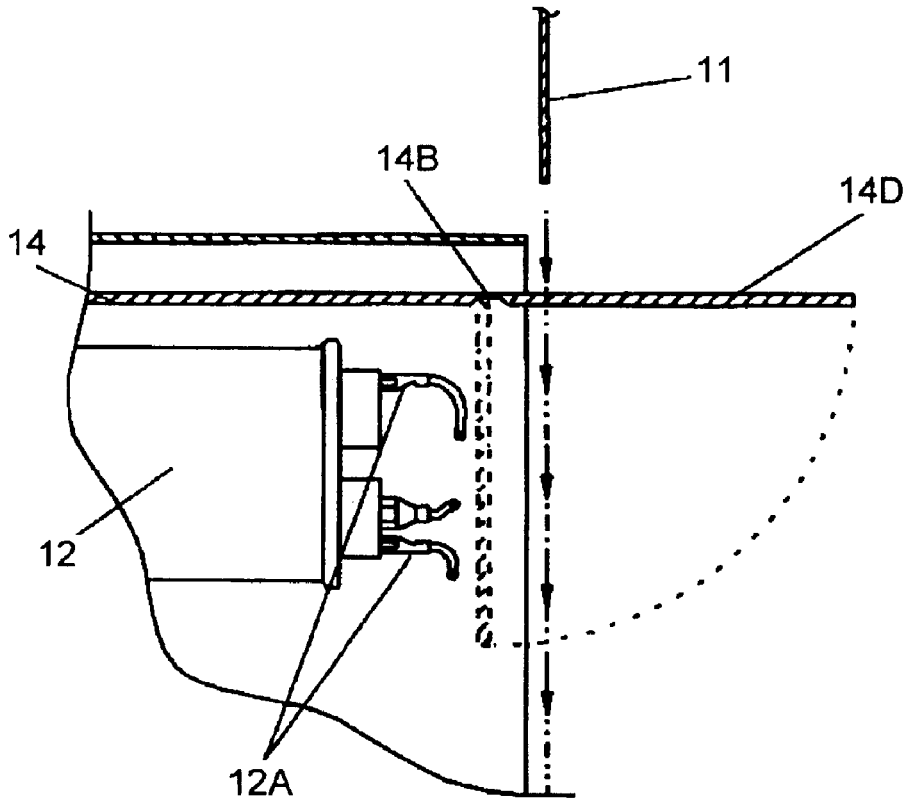
FIG. 4 is a sectional view showing a main portion of a high-frequency heating apparatus according to a second exemplary embodiment of the invention.
Figure 5:
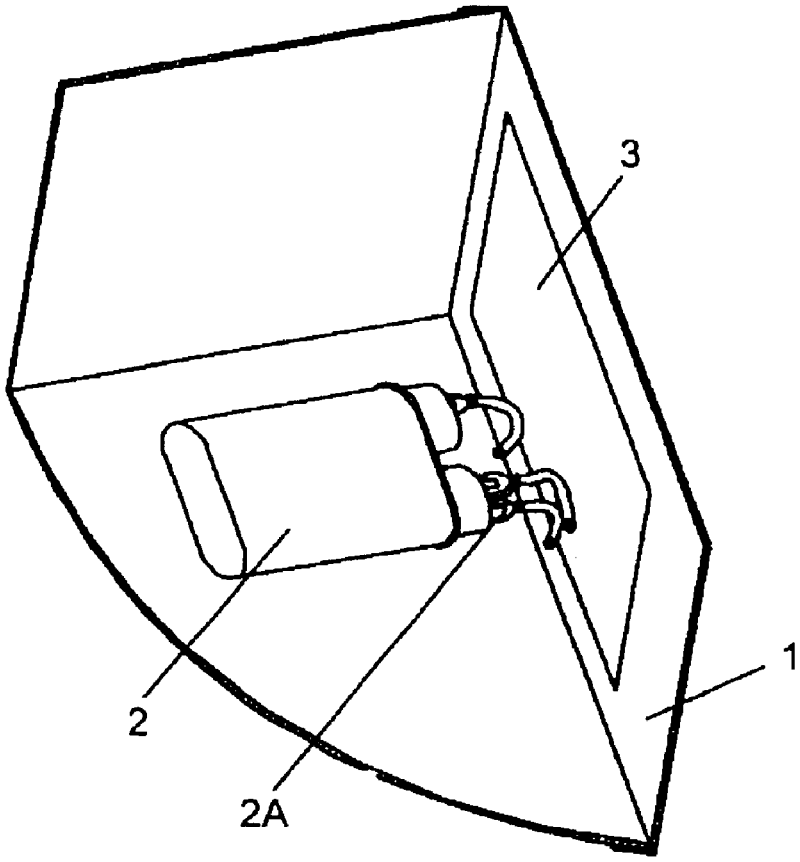
FIG. 5 PRIOR ART
FIG. 5 is a perspective view showing a main portion including an insulation sheet of a high-frequency heating apparatus of the prior art.
Figure 6:
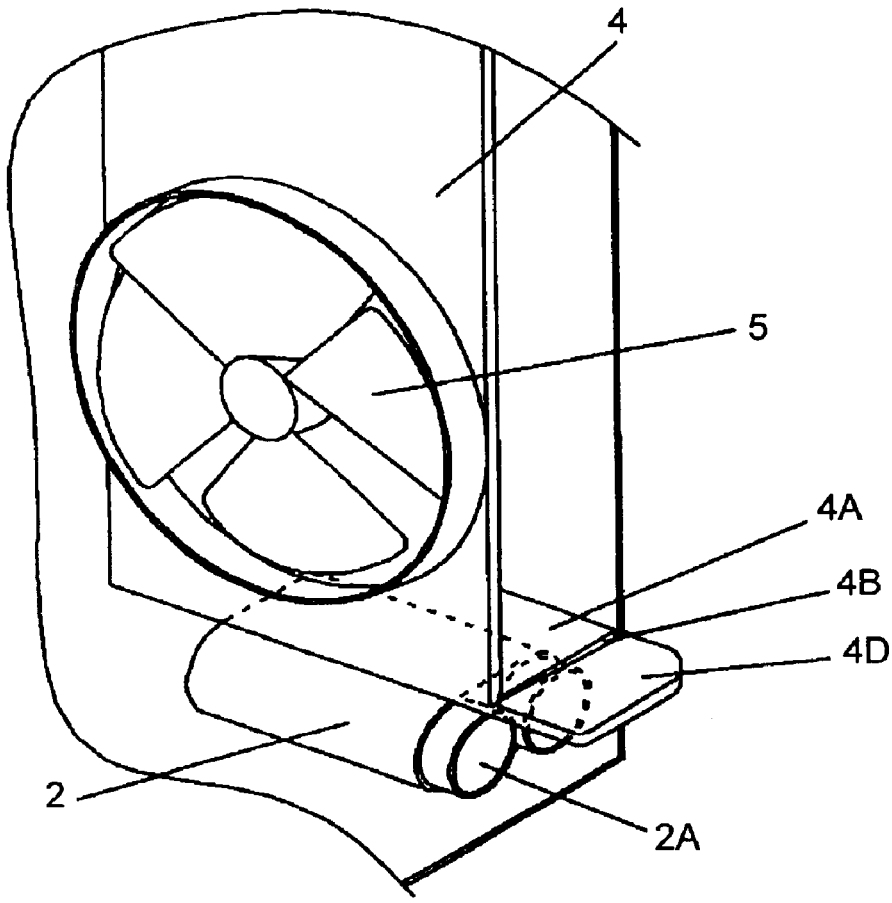
FIG. 6 PRIOR ART
FIG. 6 is a perspective view showing a main portion including a plastic hinge of a high-frequency heating apparatus of the prior art.
Figure 7:
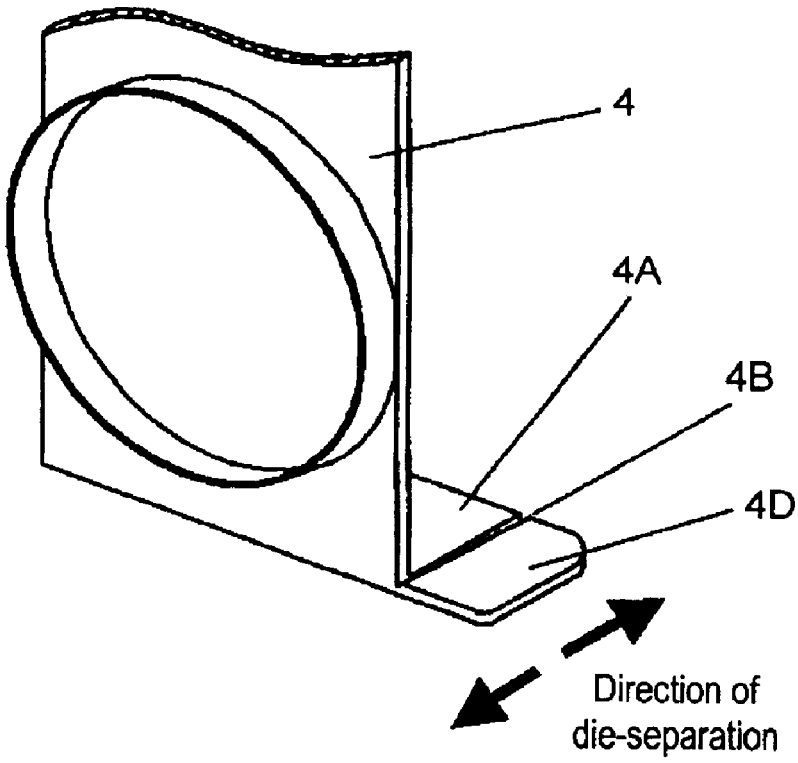
FIG. 7 PRIOR ART
FIG. 7 is a perspective view of the high-frequency heating apparatus of the prior art indicating a direction of separating a pair of molding dies of an air guide having a plastic hinge.
Figure 8:
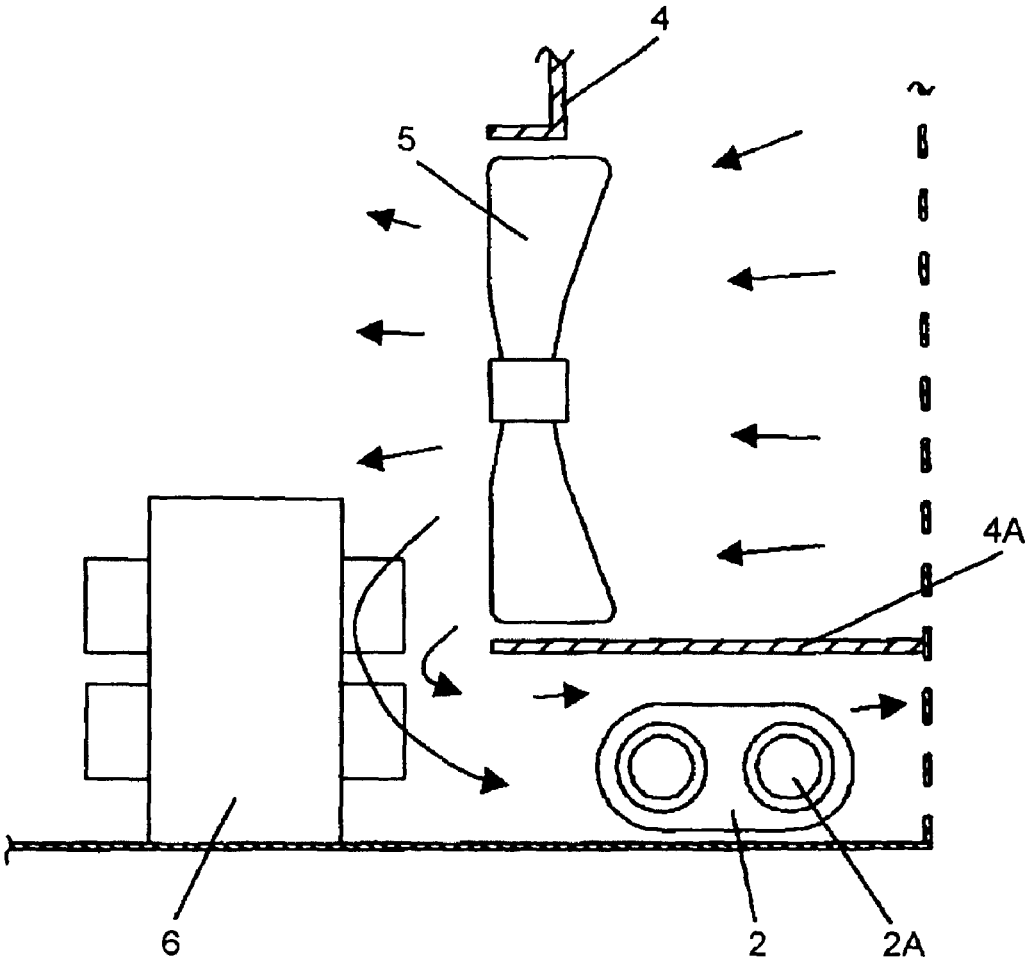
FIG. 8 PRIOR ART
FIG. 8 is a sectional view of a main portion including the plastic hinge of the high-frequency heating apparatus of the prior art.
Figure 9:
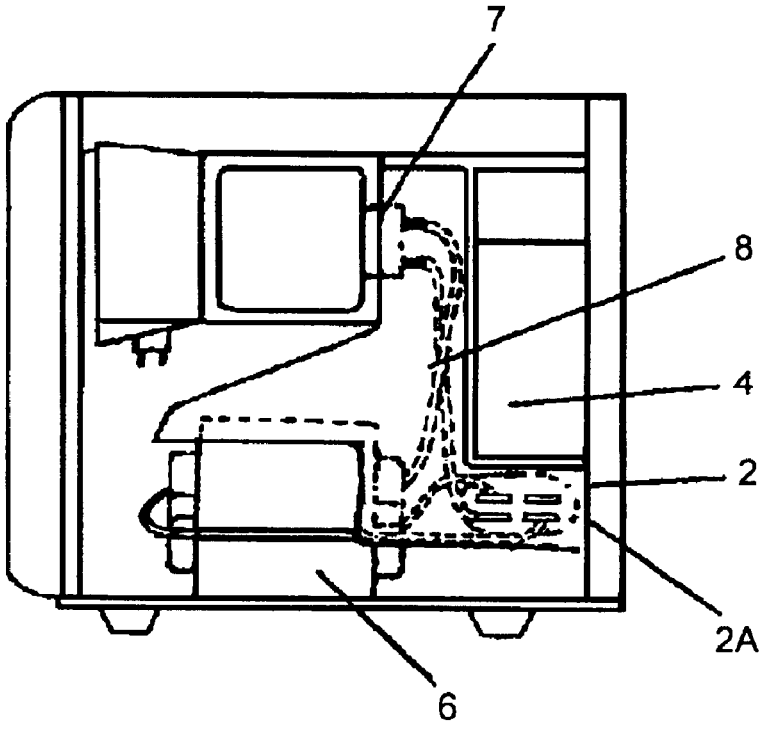
FIG. 9 PRIOR ART
FIG. 9 is a side view of a high-frequency heating apparatus of the prior art provided with an insulation cover.

FIG. 4 is an enlarged view of a main area around air guide 14 provided with plastic hinge 14B and high-voltage capacitor 12 according to the second exemplary embodiment of this invention. This embodiment differs from the structure of the first exemplary embodiment in respect that end flap 14D is located on a locus where outer enclosure 11 slides through when being installed, and thereby plastic hinge 14D is bent automatically by a movement of outer enclosure 11 as it is installed. Components having the same reference numerals as those of the first exemplary embodiment have the same structures, and their details are therefore skipped.

First, when outer enclosure 11 is being installed, it comes in contact to end flap 14D of air guide 14 extending beyond a moving locus of outer enclosure 11, and pushes to bend plastic hinge 14B. As a result, bent end flap 14D of plastic hinge 14B is moved in place between terminal 12A of high-voltage capacitor 12 and outer enclosure 11 of a dead metal part, to ensure electrical insulation easily and reliably between them without requiring a worker to bend it manually in a manufacturing process.

According to the present exemplary embodiment, as described, end flap 14D of air guide 14 is located on the locus where outer enclosure 11 slides through when it is being installed. The movement of outer enclosure 11 thus bends plastic hinge 14B automatically as it is being installed. Therefore, the structure can eliminate the time needed for the worker to place a plastic sheet for the insulation, and reduce the step of bending plastic hinge 14B in the manufacturing process.

According to the present invention, the high-frequency heating apparatus is constructed to ensure electrical insulation easily between high voltage terminal of the component, (e.g., a high-voltage transformer or a high-voltage capacitor) and the dead metal part with the end flap extending from the bendable plastic hinge provided as a part of the molded plastic member such as the air guide located near the high voltage terminal. In addition, the electrical insulation can be ensured even more positively by forming the end flap into such a shape that properly covers the terminal. This structure can also improve cooling efficiency of the high-voltage capacitor, especially if the air guide is provided with the barrier wall between the high-voltage transformer and the high-voltage capacitor, and the plastic hinge and the end flap for covering the terminal of the high-voltage capacitor are formed in the barrier wall. Moreover, the bent end flap of the plastic hinge may be provided with a cautionary marking to elicit attention to a high voltage, so as to prevent service personnel from carelessly contacting the terminal during repair work. Furthermore, since the plastic hinge is bendable automatically with installation and removal of the outer enclosure, it can improve efficiency of the repair work and reduce time needed for the repair work during an in-home service.

What is claimed is:

1. A high-frequency heating apparatus comprising:

a heating chamber for containing food;

a magnetron for heating the food and the like contained in said heating chamber;

a high-voltage generator for supplying electric power of a boosted voltage to said magnetron;

a cooler for cooling said high-voltage generator; and a molded plastic member for rectifying a flow of cooling air from said cooler, wherein said molded plastic member is provided with a plastic hinge near a terminal of said high-voltage generator, for insulating the terminal and rectifying the flow of the cooling air.

2. The high-frequency heating apparatus as in claim 1, wherein said plastic hinge is formed by partially reducing a wall thickness of said molded plastic member.

3. The high-frequency heating apparatus as in claim 1, wherein a bent end flap of said plastic hinge has a shape to cover the terminal of said high-voltage generator and isolate the terminal of said high-voltage generator from a dead metal part.

4. A high-frequency heating apparatus comprising:

a heating chamber for containing food;

a magnetron for heating the food contained in said heating chamber;

a high-voltage transformer and a high-voltage capacitor, for supplying electric power of a boosted voltage to said magnetron;

a cooling fan for cooling said magnetron and said high-voltage transformer; and an air guide made of plastic for rectifying a flow of cooling air generated by said cooling fan, wherein a part of said air guide is placed as a barrier wall between said high-voltage transformer and said high-voltage capacitor, and said barrier wall is provided with a plastic hinge for covering said high-voltage capacitor.

5. The high-frequency heating apparatus as in claim 4, wherein said plastic hinge is formed to be bendable by partially reducing a wall thickness of said barrier wall.

6. The high-frequency heating apparatus as in claim 4, wherein a bent end flap of said plastic hinge has a shape to cover a terminal of said high-voltage capacitor and isolate the terminal of said high-voltage capacitor from a dead metal part.

7. The high-frequency heating apparatus as in claim 1, wherein a bent end flap of said plastic hinge is provided with a cautionary marking for eliciting attention to a high voltage.

8. The high-frequency heating apparatus as in claim 1, further comprising a locking mechanism for holding said plastic hinge in a state where said plastic hinge is bent.

9. The high-frequency heating apparatus as in claim 1, wherein an outer enclosure is not installable unless said plastic hinge is bent.

10. The high-frequency heating apparatus as in claim 1, wherein said plastic hinge is bent by touching a part of an outer enclosure to said plastic hinge when said outer enclosure is installed.

11. The high-frequency heating apparatus as in claim 10, wherein a bent end flap of said plastic hinge is located on a locus where said outer enclosure slides through in a case of installation of said outer enclosure, and said plastic hinge is bent when said outer enclosure is installed.

12. The high-frequency heating apparatus as in claim 1, wherein said plastic hinge returns automatically to an original unbent state by elasticity thereof when said outer enclosure is removed, and a terminal isolated by a bent end flap of said plastic hinge is exposed.

13. The high-frequency heating apparatus as in claim 10, wherein said plastic hinge returns automatically to an original unbent state by elasticity thereof when said outer enclosure is removed, and a terminal isolated by a bent end flap of said plastic hinge is exposed.

14. The high-frequency heating apparatus as in claim 2, wherein a bent end flap of said plastic hinge has a shape to cover the terminal of said high-voltage generator and isolate the terminal of said high-voltage generator from a dead metal part.

15. The high-frequency heating apparatus as in claim 5, wherein a bent end flap of said plastic hinge has a shape to cover a terminal of said high-voltage capacitor and isolate the terminal of said high-voltage capacitor from a dead metal part.

16. The high-frequency heating apparatus as in claim 4, wherein a bent end flap of said plastic hinge is provided with a cautionary marking for eliciting attention to a high voltage.

17. The high-frequency heating apparatus as in claim 4, further comprising a locking mechanism for holding said plastic hinge in a state where said plastic hinge is bent.

18. The high-frequency heating apparatus as in claim 4, wherein an outer enclosure is not installable unless said plastic hinge is bent.

19. The high-frequency heating apparatus as in claim 4, wherein said plastic hinge is bent by touching a part of an outer enclosure to said plastic hinge when said outer enclosure is installed.

20. The high-frequency heating apparatus as in claim 4, wherein said plastic hinge returns automatically to an original unbent state by elasticity thereof when said outer enclosure is removed, and a terminal isolated by a bent end flap of said plastic hinge is exposed.

* * * * *